US005807183A

United States Patent [19]

Benson

[11] Patent Number: 5,807,183

[45] Date of Patent: Sep. 15, 1998

[54] GOLF-SWING TRAINING DEVICE

[76] Inventor: Michael J. Benson, 3555 W. 111th St., Chicago, Ill. 60655

[21] Appl. No.: 868,319

[22] Filed: Jun. 3, 1997

[51] Int. Cl.[6] ..... A63B 69/36

[52] U.S. Cl. ..... 473/206; 473/232; 473/234; 473/256

[58] Field of Search ..... 473/201, 206, 473/231, 232, 234, 256, 298, 299

[56] References Cited

U.S. PATENT DOCUMENTS

| | | | |
|---|---|---|---|
| 855,016 | 5/1907 | Orthwein | 473/206 |
| 1,930,342 | 10/1933 | Graham . | |
| 2,223,437 | 12/1940 | Yeager, Jr. . | |
| 2,928,678 | 3/1960 | Cutting | 473/206 |
| 3,428,325 | 2/1969 | Atkinson . | |
| 3,434,722 | 3/1969 | Esposito . | |
| 3,533,630 | 10/1970 | Monaco . | |
| 4,664,388 | 5/1987 | Huber . | |
| 4,809,975 | 3/1989 | Lee . | |
| 4,878,673 | 11/1989 | Pollard . | |
| 4,953,868 | 9/1990 | Thompson et al. . | |
| 5,100,148 | 3/1992 | Smith . | |
| 5,249,803 | 10/1993 | Giffin . | |
| 5,295,688 | 3/1994 | Montgomery . | |
| 5,312,308 | 5/1994 | Hamilton et al. . | |
| 5,405,139 | 4/1995 | Gagarin . | |
| 5,505,454 | 4/1996 | Gagarin . | |

*Primary Examiner*—George J. Marlo

*Attorney, Agent, or Firm*—Kathleen Anne Ryan

[57] ABSTRACT

A golf-swing training device includes an elongated cylindrical member which has a first end, an open second end, and a tubular channel that extends between the first end and the open second end. A stretchable member which has a first end and a second end extends through the channel and has a pre-determined length such that the second end of the stretchable member is positioned proximate the open second end of the cylindrical member. A securing mechanism fixedly secures the first end of the stretchable member to the cylindrical member proximate the first end of the cylindrical member. The device also includes a weight that is coupled to the second end of the stretchable member by a coupling mechanism. The weight can be either a ball or a golf-club head. When the device is swung like a golf club, the motion of the weight provides feedback as to whether or not the device was accelerated properly during the swinging action. The coupling mechanism couples the weight to the stretchable member so that the weight can be removed and replaced by a different weight. The device thus can be customized to accommodate the needs and preferences of different users. The device also includes a thumb guide which has a ring member, a ring guide, and a strap. The ring guide couples the ring to the strap and permits limited rotational motion of the ring member relative to the strap. The strap couples the thumb guide to a hand grip portion of the device. Because the ring guide permits limited rotational motion of the ring, the user's thumb can be properly positioned along the hand grip when the user grasps the hand grip.

20 Claims, 3 Drawing Sheets

GOLF-SWING TRAINING DEVICE

FIELD OF THE INVENTION

This invention relates generally to devices that are used in learning and mastering the game of golf and particularly to devices which assist a user in learning and mastering a correct golf-club swinging action.

BACKGROUND OF THE INVENTION

It is well established that a proper golf club swinging action is critical for attaining mastery of the game of golf. Both the manner of accelerating a golf club and the manner of grasping the club can effect the swinging action. Various devices have been proposed to assist golfers in learning and mastering a correct golf-club swinging action. For example, Giffin, U.S. Pat. No. 5,249,803, Huber, U.S. Pat. No. 4,664,338, Esposito, U.S. Pat. No. 3,434,722, Graham, U.S. Pat. No. 1,903,342, Gagarin, U.S. Pat. Nos. 5,505,454 and 5,405,139, Atkinson, U.S. Pat. No. 3,428,325, and Thompson, U.S. Pat. No. 4,953,868 disclose devices that can be used to learn to accelerate a golf club correctly. The devices of Giffin, Huber, Esposito, and Graham include weights that are secured to a shaft or handle by a flexible, non-stretchable member, such as a chain or a cord. The devices of Gagarin and Atkinson include weights that are attached to a shaft by a flexible and stretchable member, such as a vacuum-cleaner hose or elastic strips. In each of these devices, the motion of the weight, either arcuate or linear, when the device is swung like a golf-club provides physical and visual feed-back as to whether or not the device was accelerated correctly during the swinging action. The device of Thompson includes a tubular shaft in which holes are formed. When the device is properly accelerated during the swinging action, the holes provide an audible whistling sound. Although the foregoing devices can be used to learn a correct swinging action, the devices nonetheless suffer from various disadvantages. For example, some of the devices do not look anything like a conventional golf club. Users may therefore be inhibited in using the device on a public golf course. Moreover, some of the devices cannot be easily customized according to the needs of different users or to the preferences of a single user. Montgomery, U.S. Pat. No. 5,295,688 and Yeager, Jr. U.S. Pat. No. 2,223,437 disclose devices that can be used to align the user's thumb when the user grasps a golf-club hand grip. In each device the thumb is held in a position that parallels the longitudinal axis of the golf club. However, in a proper golf-club grasp the user's thumb is held at a slight angle to the golf club.

SUMMARY OF THE INVENTION

It is therefore an object of this invention to provide a golf-swing training device that helps a user to learn and master a correct golf-club swinging action.

Another object of this invention is to provide a golf-swing training device that can be used to learn to accelerate a golf club correctly.

A further object of the invention is to provide a golf-swing training device that simulates the look and feel of a conventional golf club.

Another object of the invention is to provide a golf-swing training device that can be customized according to the needs and preferences of different users.

A further object of the invention is to provide a golf-swing training device that promotes proper grasping of a golf-club hand grip.

These and other objectives and advantages are provided by the current invention which is directed to a golf-swing training device that assists a user in learning and mastering a correct golf-club swinging action. The device includes an elongated cylindrical member which has a first end, an open second end, and a tubular channel that extends between the first end and the open second end. A stretchable member which has a first end and a second end extends through the channel and has a pre-determined length such that the second end of the stretchable member is positioned proximate the open second end of the cylindrical member. A securing mechanism fixedly secures the first end of the stretchable member to the cylindrical member proximate the first end of the cylindrical member. The device also includes a weight that is coupled to the second end of the stretchable member by a coupling mechanism. The weight can be either a ball or a golf-club head. When the device is swung like a golf club, the motion of the weight provides feedback as to whether or not the device was accelerated properly during the swinging action. The device can therefore be used to learn to accelerate a golf club correctly. Moreover, the device simulates the look and feel of a conventional golf club so that users should not be inhibited in using the device on public golf courses. The coupling mechanism couples the weight to the stretchable member so that the weight can be removed and replaced by a different weight. The device thus can be customized to accommodate the needs and preferences of different users. The device also includes a thumb guide which has a ring member, a ring guide, and a strap. The ring guide couples the ring to the strap and permits limited rotational motion of the ring member relative to the strap. The strap couples the thumb guide to a hand grip portion of the device. Because the ring guide permits limited rotational motion of the ring, the user's thumb can be properly positioned along the hand grip when the user grasps the hand grip. In addition, the thumb guide can be removed from the device and used with conventional golf clubs.

DETAILED DESCRIPTION

Figure 1:
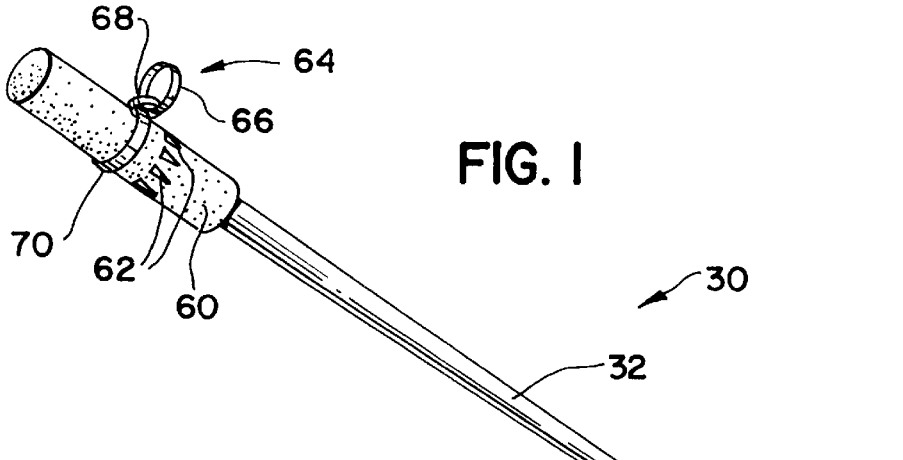
FIG. 1 is a perspective view of a golf-swing training device according to the invention.
Figure 2:
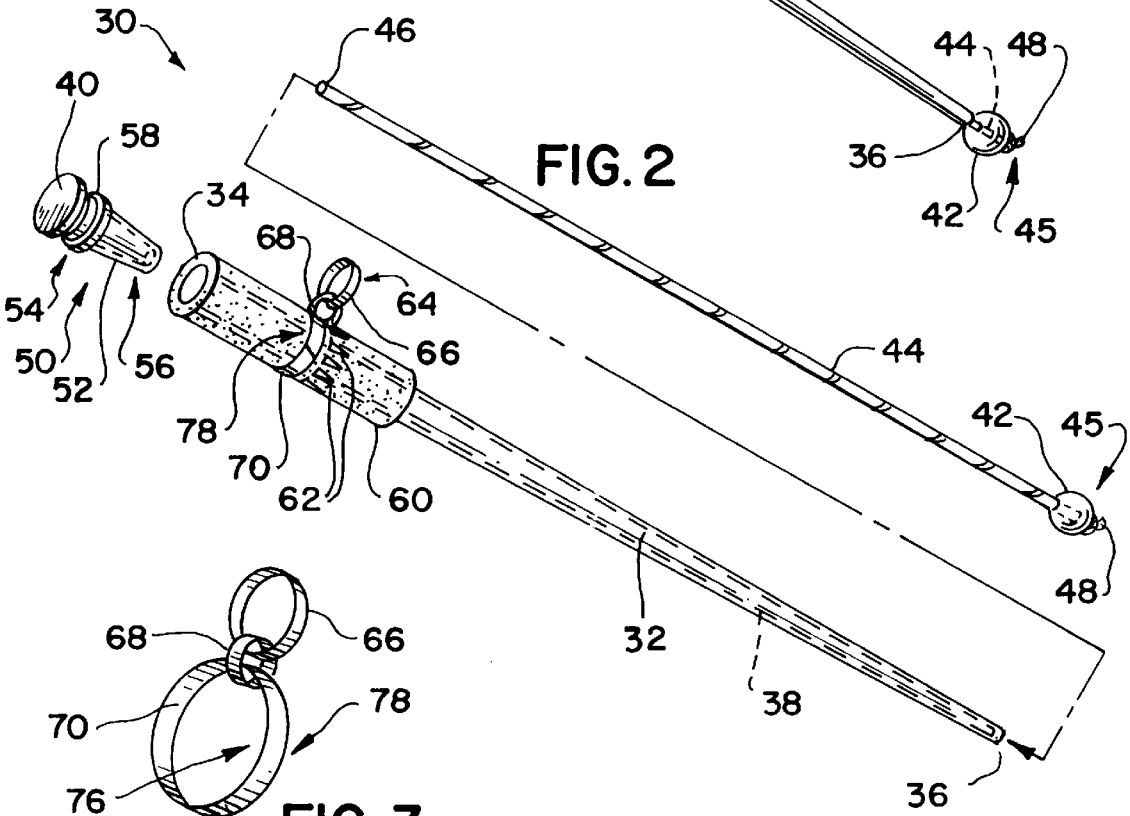
FIG. 2 is an exploded view of the device in FIG. 1.

Turning now to the drawings in which like reference numbers indicate like elements throughout, FIGS. 1 and 2 show the preferred embodiment of a golf-swing training device 30 according to the invention. The device 30 includes an elongated cylindrical member 32 that has a first end 34, an open second end 36, and a tubular channel 38 (shown in FIG. 2) that extends between the first end 34 and the open second end 36. The first end 34 preferably is also open, as shown in FIG. 2, in which case the device 30 can include a cap 40 which is used to close the first end 34. The cylindrical member 32 can be formed from any durable, rigid material, such as metal, wood, fiberglass, or rigid plastic. In the preferred embodiment, the cylindrical member 32 is formed from metal and so imitates the look and feel of a golf-club shaft. The device 30 also includes a ball 42 that is coupled to a stretchable member 44 via a coupling mechanism, shown generally at 45. The nature of the coupling mechanism 45 varies with the type of ball 42 used, as explained with reference to FIGS. 5—7. The coupling mechanism 45, together with the stretchable member 44, couple the ball 42 to the cylindrical member 32. As best seen in FIG. 2, the stretchable member 44 extends through the channel 38 and includes a first end 46 and a second end 48. The stretchable member 44 is positioned within the channel 38 so that the first end 46 of the stretchable member 44 is located proximate the first end 34 of the cylindrical member 32 and so that the second end 48 of the stretchable member is located proximate the open second end 36 of the cylindrical member 32. As explained in more detail below, when a user employs the device 30 to practice golf swings, the stretchable member 44 stretches in response to the acceleration of the cylindrical member 32 during the swinging action. The stretchable member 44 therefore is configured from any sufficiently elastic or stretchable material which will provide adequate elongation during the swinging practice. For example, the stretchable member 44 can be formed from an elongated spring. In the preferred embodiment, however, the stretchable member 44 is formed from an elastic cord, such as a bungee cord.

The device 30 also includes a securing mechanism 50 which fixedly secures the first end 46 of the stretchable member 44 to the cylindrical member 32. In the preferred embodiment, the securing mechanism 50 is a crimping member 52 that has a first end 54 and a deformable second end 56. The first end 54 of the crimping member 52 is secured to the cylindrical member 32 near the first end 34 of the cylindrical member 32 by any suitable means. For example, the first end 54 of the crimping member 52 can include a flange 58 that is secured to the cylindrical member 32 by adhesive, rivets, welding, or the like. The second end 56 of the crimping member 52 is deformed around the first end 46 of the stretchable member 44 and thereby secures the first end 46 of the stretchable member 44 to the cylindrical member 32.

Figure 3:
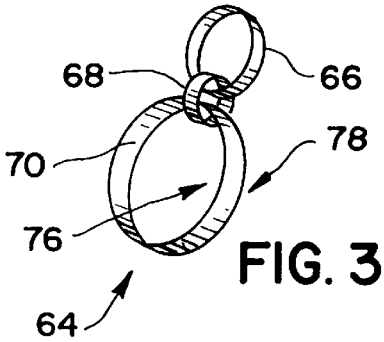
FIG. 3 is a perspective view of a thumb-guide which forms a part of the device in FIG. 1 and shows the thumb guide in a closed configuration.
Figure 4:
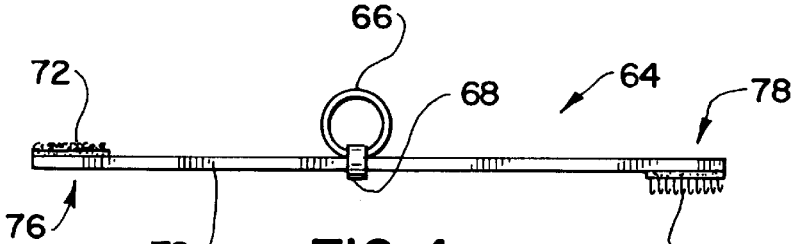
FIG. 4 is a perspective view of the thumb guide in FIG. 3 and shows the thumb guide in an open configuration.

The device 30 further includes a hand grip 60 that is secured to the cylindrical member 32 near the first end 34 thereof. The hand grip 60 provides a suitable, comfortable portion for grasping the device 30. Therefore, the hand grip 60 preferably is constructed from a resilient material, such as leather, vinyl, or foam. To assist the user in properly and reliably grasping the hand grip 60, a plurality of hand-position markings 62 are formed along the hand grip 60. The markings 62 provide visual conformation that the user has positioned his hands properly along the hand grip 60. In the preferred embodiment, individual ones of the plurality of hand-position marking 62 are visually distinct, for example, by using different colors or different shapes. The visual distinction among the hand-position markings helps to ensure that the user positions his hands on the device 30 consistently. In addition, the device 30 can include a thumb guide 64 that is positioned along the hand grip 60. The thumb guide 64 also helps to ensure that the user grasps the hand grip 60 properly. The thumb guide 64 includes a ring member 66 into which the user places a thumb and a ring guide 68 that serves to couple the ring member 66 to the hand grip 60 and to permit limited rotational motion of the ring member 66 relative to the hand grip 60. The ring guide 68 can directly couple the ring member 66 to the hand grip 60; for example, the ring guide 68 can be fastened directly to the hand grip 60. Preferably, however, the ring guide 68 reversibly couples the ring member 66 to the hand grip 60 so that the thumb guide 64 can be removed from the device 30 and used with other devices, such as conventional golf clubs. The preferred embodiment of the thumb guide 64 thus also includes a strap 70 that is interposed between the ring guide 68 and the hand grip 60. FIGS. 3 and 4 show the preferred from of the thumb guide 64 in more detail. In the preferred embodiment, the ring guide 68 is formed as a ring that encircles a portion of the ring member 66 and a portion of the strap 70. This annular configuration of the ring guide 68 permits the ring member 66 to rotate slightly relative to the strap 70 and hence to the hand grip 60. The thumb guide 64 also includes two closure members 72 and 74 which facilitate proper placement of the thumb guide 64 on the hand grip 60, as well as permitting the thumb guide 64 to be removed from the device 30. As best seen in FIG. 4, the first closure member 72 is affixed to the strap 70 along a first portion 76 thereof and the second closure member 74 is affixed to the strap 70 along a second portion 78 thereof. The second closure member 74 is positioned on the strap 70 to matingly engage the first closure member 72 and thereby to close the strap 70 into the annular configuration shown in FIG. 3. In the preferred embodiment, the closure members 72 and 74 are formed from mating pieces of Velcro. However, the closure members 72 and 74 can be formed from other suitable closing devices, such as snaps, buckles, or the like.

Figure 5:
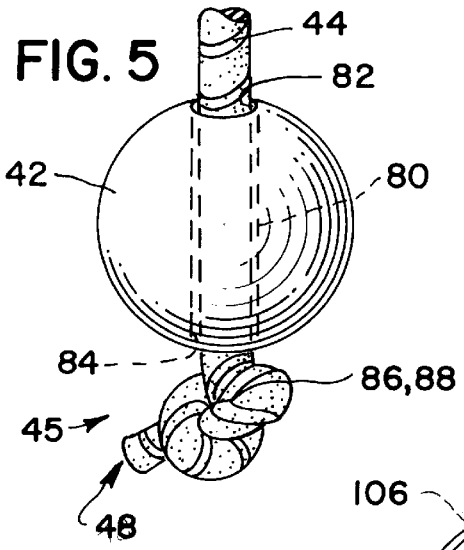
FIG. 5 is a perspective view of a ball and a retaining member which form parts of the golf-swing training device in FIG. 1.
Figure 6:
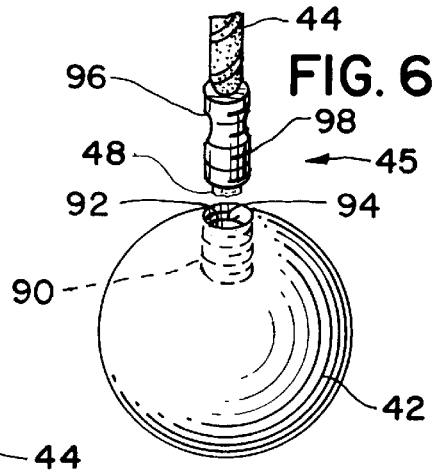
FIG. 6 is a perspective view of an alternative embodiment of the ball and the retaining member shown in FIG. 5.
Figure 7:
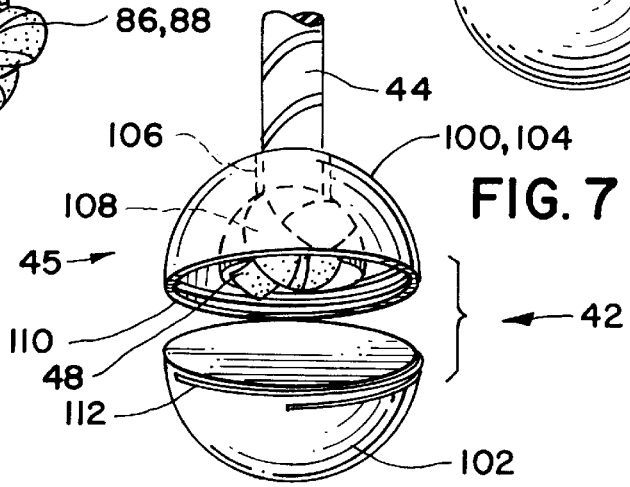
FIG. 7 is a perspective view of another alternative embodiment of the ball and the retaining member shown in FIG. 5.

The nature of the coupling mechanism 45 is now explained with reference to FIGS. 5–7. FIG. 5 shows one type of ball 42 and the associated coupling mechanism 45. In this embodiment, the ball 42 has a passageway 80 which includes an open first end 82 and an open second end 84. The second end 48 of the stretchable member 44 is inserted into the open first end 82 and extends through the passageway 80 and beyond the open second end 84 thereof. The coupling mechanism 45 includes a retaining member 86 that is associated with the second end 48 of the stretchable member 44 so that the second end 48 remains extended through the passageway 80. In its simplest form, the retaining member 86 is simply a knot 88 formed in the stretchable member 44 near the second end 48 thereof. However, any suitable retaining member 86 can be used; for example, the retaining member 86 can be a crimping device similar to the crimping member 52 used to secure the first end 46 of the stretchable member 44 to the cylindrical member 32. FIG. 6 shows a second type of ball 42 and the associated coupling mechanism 45. In this embodiment the ball 42 includes a chamber 90 that has an open end 92 and a threaded surface 94. The coupling mechanism 45 includes a retaining member 96 that is fixedly secured to the second end 48 of the stretchable member 44 by any suitable means, for example, by crimping or by adhesive. The retaining member 96 includes a threaded surface 98 that matingly engages the threaded surface 94 of the chamber 90. The ball 42 is coupled to the stretchable member 44 by inserting the retaining member 96 into the open end 92 of the chamber 90 and screwing together the ball 42 and the retaining member 96. FIG. 7 shows a third type of ball 42 and the associated coupling mechanism 45. The ball 42 is formed as two portions 100 and 102, the first portion 100 of which also acts as a retaining member 104 that couples the ball 42 to the stretchable member 44. The first portion 100 has a conduit 106 through which the second end 48 of the stretchable member 44 is inserted. The first portion 100 is fixedly secured to the second end 48 of the stretchable member 44 by any suitable means. For example, a knot 108 can be formed in the stretchable member 44 near the second end 48 thereof. Alternatively, a crimping device similar to the crimping device 52 shown in FIG. 2 can be used to fixedly secure the first portion 100 to the second end 48 of the stretchable member 44. The first portion 100 also includes a threaded surface 110 that matingly engages a threaded surface 112 formed along the second portion 102 of the ball 42. The complete ball 42 is thus coupled to the stretchable member 44 by screwing together the first portion 100 and the second portion 102.

In the preferred embodiment, the coupling mechanism 45 preferably reversibly couples the ball 42 to the stretchable member 44 so that the device 30 can be customized to the needs and preferences of different users. Consequently, in each of the embodiments shown in FIGS. 5–7, the retaining members 86, 96, and 104 facilitate removal of the ball 42 from the stretchable member 44. In FIG. 5, the knot 88 is simply untied to remove the ball 42 from the stretchable member 44. In FIG. 6 the ball 42 is removed from the stretchable member 44 by unscrewing the retaining member 96 from the ball 42. Similarly, in FIG. 7 the second portion 102 of the ball 42 is removed from the stretchable member 44 by unscrewing the second portion 102 from the first portion 100. The reversible coupling provided by the coupling mechanism 45 thus permits the weight of the ball 42 to vary by substituting balls of different weights. For example, the ball 42 in FIGS. 5 and 6 can be replaced by another ball (not shown) of different weight. Similarly, the second portion 102 of the ball 42 in FIG. 7 can be replaced to provide a different weight.

Figure 8:
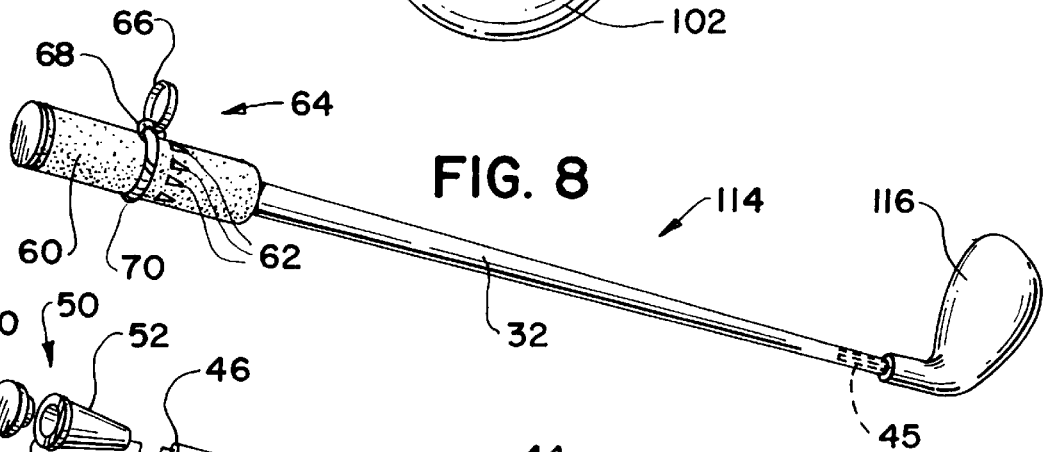
FIG. 8 is a perspective view of an alternative embodiment of a golf-swing training device according to the invention.
Figure 9:
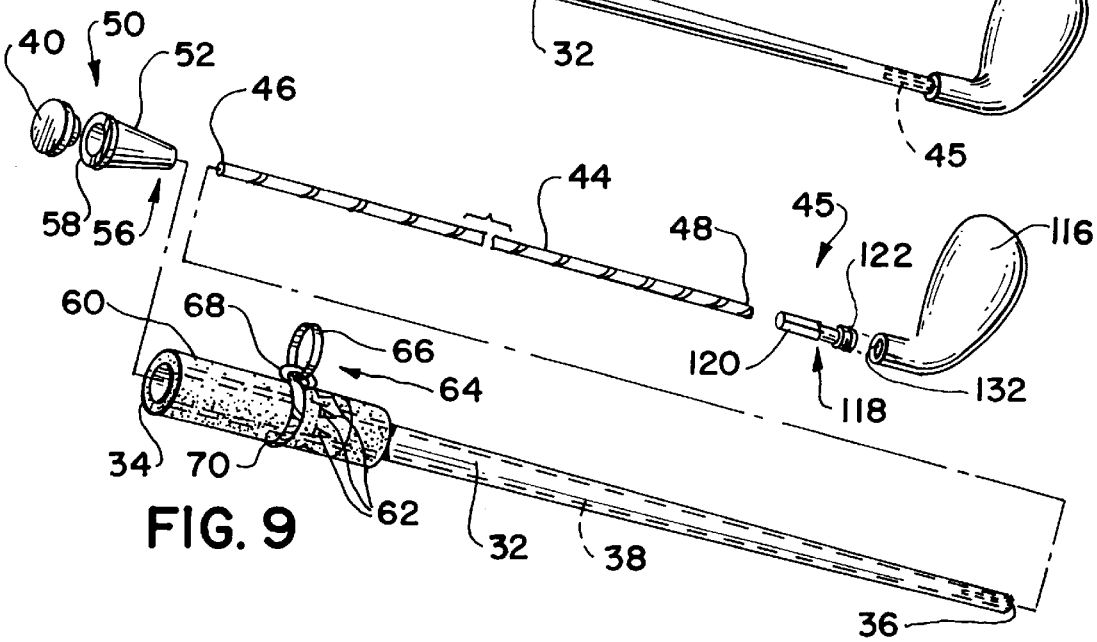
FIG. 9 is an exploded view of the golf-swing training device in FIG. 8.
Figure 10:
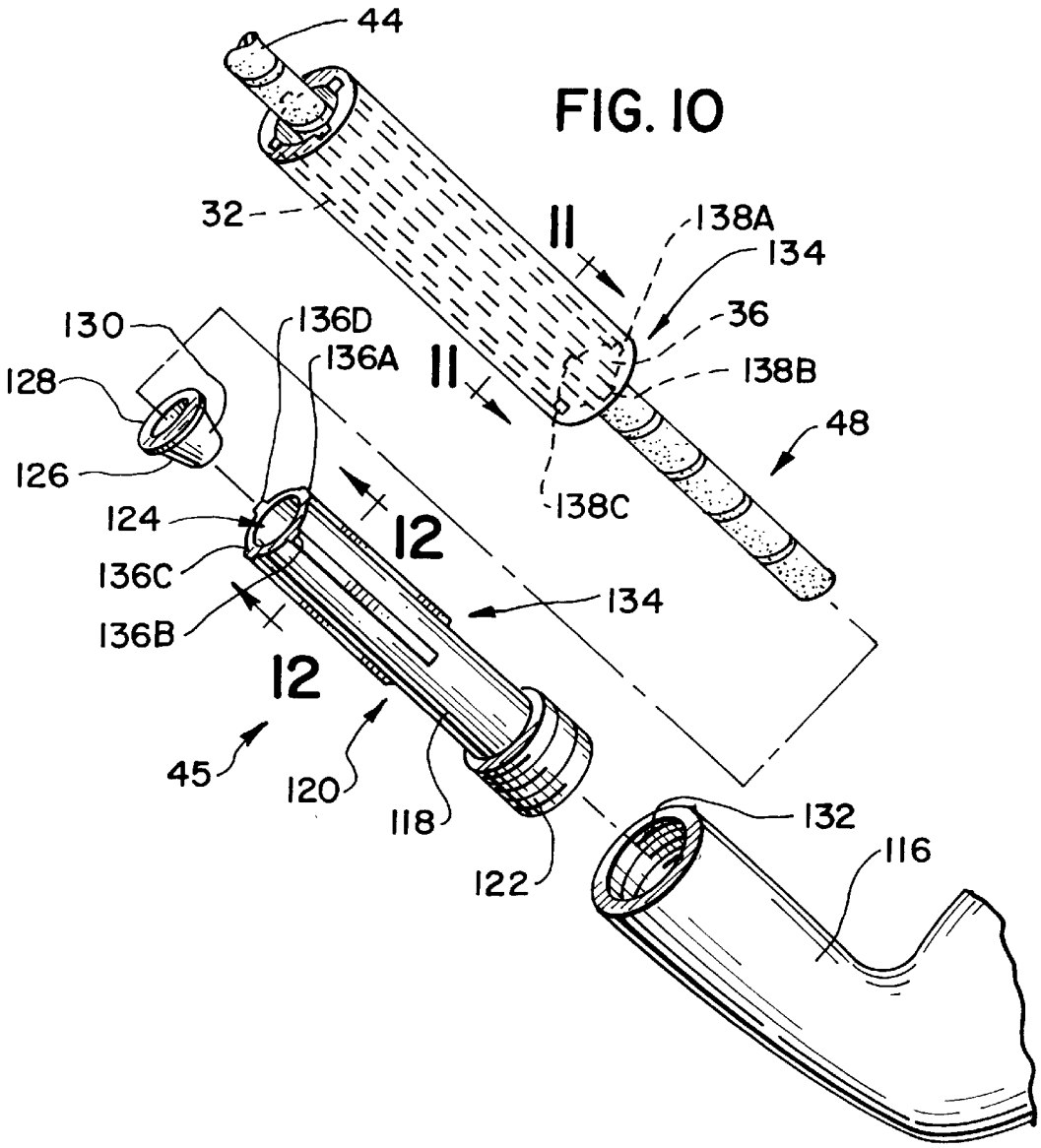
FIG. 10 is a partial enlarged exploded view of the golf-swing training device in FIG. 8 and shows a retaining member that forms a part of the golf-swing training device.

FIGS. 8 and 9 show an alternative embodiment of a golf-swing training device 114 according to the invention. Like the device 30, the device 114 includes the cylindrical member 32, the stretchable member 44 and the securing device 50. The device can also include the hand grip 60, the hand-position markings 62, and the thumb guide 64. The device 114 differs from the previous embodiment 30 in that a golf club head 116 is secured to the second end 48 of the stretchable member 44 instead of the ball 42. The device 114 also differs in the form of the coupling mechanism 45 used to couple the club head 116 to the stretchable member 44. FIG. 10 shows the club head 116 and the coupling mechanism 45 in more detail. The coupling mechanism 45 includes a tubular retaining member 118 that has an elongated portion 120 which terminates in a threaded surface 122. The retaining member 118 preferably is formed from metal but can be formed from any suitably rigid and durable material, such as hard plastic or fiberglass. The second end 48 of the stretchable member 44 is inserted into an open end 124 of the tubular retaining member 118 opposite the threaded surface 122. The second end 48 is fixedly secured to the tubular retaining member 118 by any suitable means. For example, a crimping member 126 with a flange 128 and deformable portion 130 can be used to fixedly secure the second end 48 to the retaining member 118 as described previously with reference to the crimping member 52 shown in FIG. 2. The threaded surface 122 of the retaining member 118 matingly engages a threaded surface 132 formed along the club head 116 and thereby couples the club head 116 to the stretchable member 44. In addition, the elongated portion 120 of the retaining member 118 is at least partially positioned within the channel 38 of the cylindrical member 32, as best seen in FIG. 8. The device 114 therefore has the appearance of a conventional golf club. Moreover, the device 114 can be customized to the needs and preferences of different users by uncoupling the club head 116 from the stretchable member 44 and substituting club heads of different weights.

Figure 11:
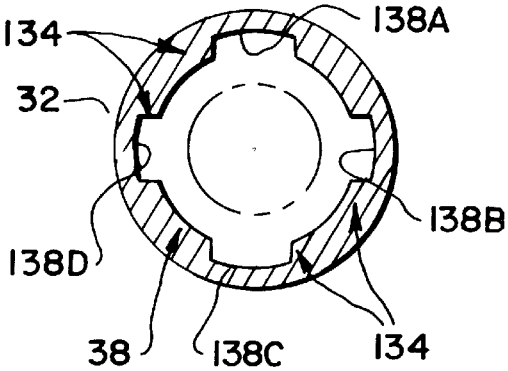
FIG. 11 is a cross-sectional view along line 11—11 in FIG. 10.
Figure 12:
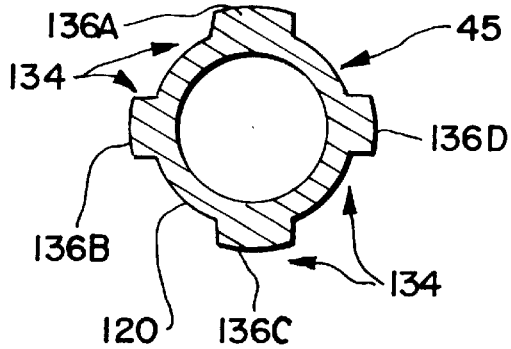
FIG. 12 is a cross-sectional view along line 12—12 in FIG. 10.

It will be noted that the club head 116, unlike the ball 42, is asymmetrical. Consequently, if the club head 116 rotates when the user swings the device 114 the weight distribution of the head 116, as well as the appearance of the device 114, will vary during use. The device 114 therefore also includes an anti-rotational 134 mechanism that prevents the retaining member 118 from rotating within the channel 38 and thus maintains a consistent alignment of the club head 116. As shown in FIGS. 11 and 12, the anti-rotational mechanism 134 includes projecting guide members 136A–D that engage groove members 138A–D and thereby limit the rotation of the retaining member 118. As shown in FIGS. 9 and 10 the guide members 136A–D preferably are positioned along the elongated portion 120 of the retaining member 118 and the groove members 138A–D are formed along the cylindrical member 32 near the open second end 36 thereof. It should be noted, however, that the positions of the guide members 136A–D and the groove members 138A–D can be reversed so that the guide members 136A–D are positioned along the channel 38 of the cylindrical member 32 near the open second end 36 and the groove member 138A–D are formed along the elongated portion 120 of the retaining member 118.

When practicing golf-club swinging actions with the devices 30 and 114, the user holds the devices 30 and 114 by grasping the hand grip 60. The user can achieve a consistent hand-placement on the hand grip 60 by aligning his leading thumb with a pre-selected one of the hand-position markings 62. Once the proper hand-placement is determined, use of the hand-position markings 62 in this manner helps to ensure that the user positions his hands on the devices 30 and 114 consistently. The hand-position markings 62 thus help to eliminate problems in obtaining a proper swinging action which can arise from inconsistent or improper hand-placement. The user can also employ the thumb guide 64 to achieve a proper grip of the devices 30 and 114 by inserting his leading thumb into the ring member 66 of the thumb guide 64. As noted earlier, the ring guide 68 permits limited rotational movement of the ring member 66 relative to the hand grip 60. Consequently, the thumb guide 64 facilitates the slight angular orientation of the user's leading thumb, relative to the hand grip 60, that is a hallmark of a proper grasp. Moreover, the thumb guide 64 also limits changes in the orientation of the user's leading thumb as can occur, for example, if the user's hands slip or if the user bends his wrists improperly when using the devices 30 and 114. The thumb guide 64 thus not only helps to ensure that the user initially grasps the devices 30 and 114 correctly, but also helps to ensure that the user maintains a proper grasp while using the devices 30 and 114. The thumb guide 64 therefore helps to eliminate problems in obtaining a proper swinging action which can arise from an improper grasp. It should be noted that the devices 30 and 114 can be used without employing either the hand-position markings 62 or the thumb guide 64. However, a proper swinging action is facilitated by using the hand-position markings 62, the thumb guide 64, or both. It should also be noted that the thumb guide 64 can be removed from the devices 30 and 144 and used with other devices, such as conventional golf clubs. The thumb guide 64 therefore also helps to promote a proper swinging action when the user is actually golfing rather than just practicing golf swings.

After grasping the device 30 or 114, the user employs the device 30 or 114 to practice golf-club swing action by completing a stroke as if hitting a golf ball with a conventional golf club. During the swinging action, at least three conditions are required, in addition to correct hand alignment and proper grasp, to obtain a proper golf club swinging action: (1) the club should be smoothly accelerated throughout the entire stroke; (2) during the down swing, maximum acceleration of the golf club should occur when the club head contacts the golf ball; and (3) the user's arms should be fully extended throughout the down swing and throughout most of the follow through. The devices 30 and 114 provide both visual and sensory feed back as to whether or not these conditions are being satisfied. As the user swings the device 30 or 114, the stretchable member 44 stretches in response to the acceleration of the device 30 or 114. If the device 30 or 114 is smoothly accelerated during the stroke, the stretchable member 44 will remain aligned with the longitudinal axis of the cylindrical member 32. Conversely, changes in the acceleration of the device 30 or 114, as can occur during a chopping or jerky swinging action, will cause the stretchable member 44 and the weight 42 or 116 to move out of alignment with the cylindrical member. Consequently, if the user does not accelerate the device 30 or 144 smoothly during the swinging action, the weight 42 or 116 will pivot relative to the cylindrical member 32, thereby providing visual and sensory feed back that smooth acceleration was not achieved. If maximum acceleration is achieved at the ball-contact point, the weight 42 or 116 similarly remains aligned with the cylindrical member 32 and remains airborn. However, if the user achieves maximum acceleration prematurely, the weight 42 or 116 will lead the cylindrical member 32 and either will hit the ground or will not extend in alignment with the cylindrical member 32. The devices 30 and 114 thus provide visual and sensory feed back that maximum acceleration was achieved prematurely. In addition, as the device 30 or 114 is accelerated during the down swing and throughout most of the follow through, the weight 42 or 116 "pulls" on the stretchable member 44 and thereby encourages the user to extend his arms fully. The devices 30 and 114 thus help the user to achieve full arm extension.

Although the present invention has been described with reference to specific embodiments thereof, it will be understood that various changes and modifications will be suggested to one skilled in the art and it is intended that the invention encompass such changes and modifications as fall within the scope of the appended claims.

What is claimed is:

1. A golf-swing training device, comprising:

an elongated cylindrical member having a first end, an open second end, and a tubular channel extending between said first end and said open second end;

a stretchable member extending through said channel, having a first end and a second end, and having a pre-determined length such that said second end of said stretchable member is positioned proximate said open second end of said cylindrical member;

securing means for fixedly securing said first end of said stretchable member to said cylindrical member proximate said first end of said cylindrical member;

a weight; and coupling means for coupling said weight to said second end of said stretchable member.

2. The golf swing training device of claim 1 wherein said securing means includes a crimping member having a first end and a deformable second end, said first end of said crimping member being secured to said cylindrical member proximate said first end of said cylindrical member, said deformable second end of said crimping member being deformed around said first end of said stretchable member.

3. The golf-swing training device of claim 1 wherein said weight is a ball.

4. The golf-swing training device of claim 1 wherein said weight is a golf-club head.

5. The golf-swing training device of claim 1 wherein said weight includes a passageway having an open first end and an open second end, and said second end of said stretchable member extends through said passageway and beyond said open second end of said weight, and wherein said coupling means includes a retaining member associated with said second end of said stretchable member such that said second end of said stretchable member remains extended through said passageway.

6. The golf-swing apparatus of claim 1 wherein said weight includes a threaded surface and wherein said coupling means includes a retaining member fixedly secured to said second end of said stretchable member and having a threaded surface, said threaded surface of said weight matingly engaging said threaded surface of said retaining member.

7. The golf-swing training device of claim 6 wherein said retaining member further includes an elongated portion positioned opposite said threaded surface of said retaining member, said elongated portion being positioned at least partially within said channel of said cylindrical member.

8. The golf-swing training device of claim 7 further including anti-rotational means for preventing rotating of said retaining member within said channel.

9. The golf-swing training device of claim 8 wherein said anti-rotational means includes at least one projecting guide member and at least one groove member positioned to engage said guide member.

10. The golf-swing training device of claim 9 wherein said guide member is positioned along said elongated portion of said retaining member and said groove member is formed along said cylindrical member proximate said open second end.

11. The golf-swing training device of claim 1 further including a hand-grip secured to said cylindrical member proximate said first end of said cylindrical member.

12. The golf-swing training device of claim 11 further including a plurality of hand-position markings formed along said hand grip.

13. The golf-swing training device of claim 12 wherein individuals ones of said plurality of hand-position markings are visually distinct.

14. The golf-swing training device of claim 11 further including a thumb guide positioned along said hand grip.

15. The golf-swing training device of claim 14 wherein said thumb guide includes a ring member and a ring guide, said ring guide coupling said ring to said hand grip and permitting limited rotational movement of said ring member relative to said hand grip.

16. The golf-swing training device of claim 15 wherein said thumb guide further includes a strap interposed between said ring guide and said hand grip, said ring guide being affixed to said strap.

17. The golf-swing training device of claim 16 wherein said thumb guide is removably positioned along said hand grip.

18. A golf-swing training device for use with a golf club having a hand grip portion, comprising:

a thumb guide having a ring member, a ring guide, and a strap, said ring guide coupling said ring to said strap and permitting limited rotational motion of said ring member relative to said strap, said strap for coupling said thumb guide to the hand grip portion of the golf club.

19. The golf swing training device of claim 18 further including closure means for closing said strap into a substantially annular configuration.

20. The golf-swing training device of claim 19 wherein said closure means includes a first closure member affixed to said strap along a first portion thereof and a second closure member affixed to said strap along a second portion thereof and positioned to matingly engage said first closure member.

* * * * *